US011040548B1

(12) United States Patent
Cheever et al.

(10) Patent No.: US 11,040,548 B1
(45) Date of Patent: Jun. 22, 2021

(54) THERMAL TRANSFER PRINTERS FOR DEPOSITION OF THIN INK LAYERS INCLUDING A CARRIER BELT AND RIGID BLADE

(71) Applicant: Dover Europe Sarl, Vernier (CH)

(72) Inventors: James M. Cheever, Keene, NH (US); Aljosa Sarcevic, Nottingham (GB); Stacey C. Goodale, Swanzey, NH (US)

(73) Assignee: Dover Europe Sarl, Vernier (CH)

( * ) Notice: Subject to any disclaimer, the term of this patent is extended or adjusted under 35 U.S.C. 154(b) by 0 days.

(21) Appl. No.: 16/709,759

(22) Filed: Dec. 10, 2019

(51) Int. Cl.
*B41J 2/33* (2006.01)
*B41J 2/005* (2006.01)

(52) U.S. Cl.
CPC ..... *B41J 2/33* (2013.01); *B41J 2/0057* (2013.01)

(58) Field of Classification Search
CPC ..... B41J 2/33; B41J 2/0057
See application file for complete search history.

(56) References Cited

U.S. PATENT DOCUMENTS

| | | | |
|---|---|---|---|
| 1,957,611 | A | 5/1934 | Pelton |
| 3,664,915 | A | 5/1972 | Gore |
| 3,731,649 | A | 5/1973 | Anderson et al. |
| 3,953,566 | A | 4/1976 | Gore |
| 4,096,227 | A | 6/1978 | Gore |
| 4,187,390 | A | 2/1980 | Gore |
| 4,253,775 | A | 3/1981 | Crooks et al. |
| 4,268,368 | A | 5/1981 | Aviram et al. |
| 4,421,429 | A | 12/1983 | Graham |
| 4,462,035 | A | 7/1984 | Koto |
| 4,478,665 | A | 10/1984 | Hubis |
| 4,482,516 | A | 11/1984 | Bowman |
| 4,707,155 | A | 11/1987 | Burkhead et al. |
| 4,725,860 | A | 2/1988 | Kohyama et al. |

(Continued)

FOREIGN PATENT DOCUMENTS

| | | |
|---|---|---|
| DE | 10051850 | 10/2001 |
| EP | 182011 | 1/1988 |

(Continued)

OTHER PUBLICATIONS

International Application No. PCT/IB2017/056191, Notification of Transmittal of the International Search Report and the Written Opinion of the International Searching Authority, dated Feb. 23, 2018, 14 pages.

(Continued)

*Primary Examiner* — Lamson D Nguyen
(74) *Attorney, Agent, or Firm* — Fish & Richardson P.C.

(57) ABSTRACT

In some embodiments, a printing apparatus comprises a band capable of holding hot melt ink thereon, rollers configured and arranged to hold and transport the band with respect to a substrate, a printhead configured to thermally transfer a portion of hot melt ink from the band to the substrate to print on the substrate, an ink feed device configured to add hot melt ink to the band and to heat the hot melt ink on the band, and a rigid blade configured and arranged to cause hot melt ink to pass between a blade edge of the rigid blade and the band, wherein the rigid blade is shaped to minimize a contact area between the rigid blade and the band while controlling ink thickness of the hot melt ink on the band.

20 Claims, 15 Drawing Sheets

(56) References Cited

U.S. PATENT DOCUMENTS

| | | | | |
|---|---|---|---|---|
| 4,809,447 | A | 3/1989 | Pacanowsky | |
| 4,824,514 | A | 4/1989 | Schneider | |
| 4,877,661 | A | 10/1989 | House | |
| 4,925,710 | A | 5/1990 | Buck et al. | |
| 5,019,836 | A | 5/1991 | Iwata et al. | |
| 5,026,513 | A | 6/1991 | House | |
| 5,054,943 | A | 10/1991 | Cheng | |
| 5,137,382 | A | 8/1992 | Miyajima | |
| 5,198,835 | A | 3/1993 | Ando et al. | |
| 5,316,885 | A | 5/1994 | Sasaki | |
| 5,336,000 | A | 8/1994 | Handa | |
| 5,455,604 | A * | 10/1995 | Adams | B41J 11/002 101/409 |
| 5,458,954 | A | 10/1995 | Ogi et al. | |
| 5,494,301 | A | 2/1996 | Hamilton | |
| 5,505,887 | A | 4/1996 | Zdrahala | |
| 5,518,012 | A | 5/1996 | Dolan | |
| 5,552,231 | A * | 9/1996 | Talvalkar | B41M 5/395 428/32.83 |
| 5,620,763 | A | 4/1997 | House | |
| 5,738,936 | A | 4/1998 | Hanrahan | |
| 5,746,522 | A | 5/1998 | Moreland | |
| 5,759,655 | A | 6/1998 | Kitajima | |
| 5,814,405 | A | 9/1998 | Branca | |
| 5,865,115 | A | 2/1999 | Fassler et al. | |
| 5,907,348 | A | 5/1999 | Ogasawara | |
| 6,031,553 | A | 2/2000 | Nagamoto | |
| 6,037,959 | A | 3/2000 | Fassler et al. | |
| 6,048,484 | A | 4/2000 | House | |
| 6,128,464 | A | 10/2000 | Taniguchi | |
| 6,133,931 | A | 10/2000 | Yoshikawa | |
| 6,187,054 | B1 | 2/2001 | Colone | |
| 6,396,528 | B1 | 5/2002 | Yanagawa | |
| 6,530,765 | B1 | 3/2003 | Zdrahala | |
| 6,704,037 | B1 | 3/2004 | Taguchi | |
| 6,737,158 | B1 | 5/2004 | Thompson | |
| 6,801,236 | B2 | 10/2004 | Araki | |
| 7,147,378 | B2 | 12/2006 | Chu | |
| 7,639,269 | B2 | 12/2009 | Mizukami et al. | |
| 7,675,533 | B2 | 3/2010 | Tamura | |
| 7,815,761 | B2 * | 10/2010 | Phillips | B65C 9/1896 156/80 |
| 8,137,015 | B2 | 3/2012 | Noda | |
| 8,231,935 | B2 | 7/2012 | Ihara et al. | |
| 8,654,164 | B2 | 2/2014 | Mochizuki | |
| 8,668,396 | B2 | 3/2014 | Ihara et al. | |
| 8,917,297 | B2 | 12/2014 | Dong | |
| 8,922,611 | B1 | 12/2014 | Benton | |
| 2004/0179881 | A1 | 9/2004 | White et al. | |
| 2004/0223043 | A1 | 11/2004 | Araki | |
| 2005/0186367 | A1 | 8/2005 | Hanrahan | |
| 2010/0012023 | A1 | 1/2010 | Lefevre et al. | |
| 2012/0086763 | A1 | 4/2012 | McNestry et al. | |
| 2012/0236089 | A1 | 9/2012 | Iftime et al. | |
| 2013/0039685 | A1 | 2/2013 | Starkey et al. | |
| 2013/0257996 | A1 | 10/2013 | Panchawagh et al. | |
| 2016/0176185 | A1 | 6/2016 | Kanungo et al. | |
| 2017/0185007 | A1 | 6/2017 | Kochi | |
| 2020/0039264 | A1 | 2/2020 | Benjamin | |
| 2020/0039265 | A1 | 2/2020 | Benjamin | |

FOREIGN PATENT DOCUMENTS

| | | | |
|---|---|---|---|
| EP | 417488 | | 10/1993 |
| EP | 3106308 | A1 | 12/2016 |
| FR | 2544666 | | 4/1986 |
| GB | 2488891 | | 9/2012 |
| GB | 2543061 | A | 4/2017 |
| JP | S5849290 | | 3/1983 |
| JP | 59091086 | | 5/1984 |
| JP | S6195961 | | 5/1986 |
| JP | 61221046 | | 10/1986 |
| JP | S62191157 | | 8/1987 |
| JP | H03213357 | | 9/1991 |
| JP | H4235080 | | 8/1992 |
| JP | H054456 | | 1/1993 |
| JP | H06155857 | | 5/1994 |
| JP | H8230339 | | 9/1996 |
| JP | H1034988 | | 2/1998 |
| JP | 2013040250 | | 2/2013 |
| WO | WO2002032684 | | 4/2002 |
| WO | WO2018065959 | A1 | 4/2018 |

OTHER PUBLICATIONS

International Application No. PCT/IB2017/056192, Notification of Transmittal of the International Search Report and the Written Opinion of the International Searching Authority, dated Feb. 23, 2018, 13 pages.

International Application No. PCT/IB2017/056193, Notification of Transmittal of the International Search Report and the Written Opinion of the International Searching Authority, dated Feb. 23, 2018, 14 pages.

Application No. GB1517636.5, Search Report under Section 17, dated Mar. 24, 2016, 2 pages.

International Application No. PCT/EP2016/073847, Notification of Transmittal of the International Search Report and the Written Opinion of the International Searching Authority, dated Jan. 31, 2017, 15 pages.

Thornwood, "Fabric Printer Ribbon with Improved Yield", IBM Technical Disclosure Bulletin, International Business Machines Corp., US, vol. 33, No. 4, Sep. 1, 1990, p. 239.

Wikipedia Navier-Stokes equations, https://en.wikipedia.org/wiki/Navier%E2%80%93Stokes_equations, Sep. 14, 2017, 14 pages.

http://en.wikipedia.org/wiki/Kapton, Kapton, downloaded Aug. 26, 2013, 3 pages.

http://en.wikipedia.org/wiki/Thermal_transfer_printing, "Thermal transfer printing", downloaded Sep. 24, 2013, 2 pages.

Nakaya et al., "Thermal Ink Transfer Printer with Ink Layer Reformation Mechanism", SID Digest, pp. 56-57, 1983.

Sanders, "Heat conduction in thermal transfer printing", Can. J. Chem. vol. 63, pp. 184-188 (1985).

European Application No. 20212785.8, Extended European Search Report dated Apr. 23, 2021, 8 pages.

* cited by examiner

THERMAL TRANSFER PRINTERS FOR DEPOSITION OF THIN INK LAYERS INCLUDING A CARRIER BELT AND RIGID BLADE

TECHNICAL FIELD

This application relates to systems and techniques for thermal transfer printing.

BACKGROUND

Thermal transfer printing involves the use of a ribbon to carry a material (e.g., ink) to the location of a printhead, where heat is then used to transfer the material from the ribbon to a substrate (e.g., paper or plastic). Many different variations of this general process have been developed over the last sixty years, and various improvements have also been made in the configurations and control systems employed for thermal transfer printers. In a continuous band thermal printing apparatus, the band is recirculated within the system and re-inked with each revolution of the band in the system. The substrate to be printed is advanced continuously past the printhead during each printing operation. The printhead includes a plurality of selectively energizable printing elements that enable a pixel of ink to be transferred to the substrate. The energization of the printing elements is controlled to transfer ink to the substrate in a desired pattern. The printhead contacts an ink-free side of the inked band, and presses the opposite, inked, side of the band against the substrate to transfer pixels of ink from the ribbon to the substrate by heat. The length of time that a pixel of ink is exposed to a heated printing element prior to the pixel being transferred from the band to the substrate affects print quality; there is an optimum heating period to achieve a satisfactory transfer, with patchy and inconsistent prints if the ink is not heated for long enough or a blurred or smeared print if heated for too long. Various methods of manufacturing the inked band are also possible.

SUMMARY

This disclosure is based, in part, on the discovery that using a metal rigid coating blade levels the ink when used with a compliant opposing surface and produces a uniform coating height of the ink. A deformable carrier belt transports the printing band around the printer and can be used in conjunction with the rigid coating blade. The carrier belt can have a minimum Shore Hardness A of in the range of 50 to 100 (inclusive) to prevent excessive deformation and to prevent an overly thick ink coating. In some implementations, the carrier belt has a Shore Hardness A in the range of 60 to 90, or 70 to 80, 70 to 90, or 80 to 100 (all inclusive).

In some embodiments, a printing apparatus comprises a band capable of holding hot melt ink thereon, rollers configured and arranged to hold and transport the band with respect to a substrate, a printhead configured to thermally transfer a portion of hot melt ink from the band to the substrate to print on the substrate, an ink feed device configured to add hot melt ink to the band and to heat the hot melt ink on the band, and a rigid blade configured and arranged to cause hot melt ink to pass between a blade edge of the rigid blade and the band, wherein the rigid blade is shaped to minimize a contact area between the rigid blade and the band while controlling ink thickness of the hot melt ink on the band.

In some implementations, the rigid blade has a blade edge with a radius of curvature between 0.15 and 0.3 mm. The rigid blade has a front surface that forms an angle between 30 degrees and 90 degrees with respect to the band. The rigid blade is configured to restrict ink from passing beyond lateral edges of the rigid blade. The rigid blade has a lateral curvature that funnels ink towards a midline of the band. The rigid blade has side shields at the lateral edges of the rigid blade. The rigid blade has a rear surface that defines an ink/air interface and has an angle of above 30 degrees and below 90 degrees with respect to the band. The ink feed device comprises a slot die in communication with a slot within a body of the rigid blade that delivers hot melt ink to the band.

In some embodiments, a printing apparatus comprises an ink band capable of holding hot melt ink thereon, an ink feed device configured to deposit hot melt ink on the ink band, ink band rollers configured and arranged to hold and transport the ink band with respect to a substrate, a printhead configured to thermally transfer a portion of hot melt ink from the ink band to the substrate to print on the substrate, a rigid blade configured to control a thickness of the hot melt ink deposited on the ink band, a carrier belt in contact with the ink band, and carrier rollers configured and arranged to hold and transport the carrier belt with respect to the ink feed device, wherein the carrier belt is formed of at least a first material component and a second material component, the first material component providing the carrier belt with compliance that controls the thickness of the hot melt ink deposited on the ink band in conjunction with the rigid blade, and the second material component prevents or reduces elongation of the carrier belt.

In some implementations, the carrier belt is formed from a single material that comprises both the first material component and the second material component. The first and second material components are respective first and second layers. The first layer comprises a material with a Shore A Hardness between 50 and 100. The first layer is silicone rubber. The first material component layer comprises a material with a Shore A Hardness between 60 and 100. The second material component comprises a material that has a friction coefficient of greater than 0.1 when in contact with the carrier rollers. The second layer is Kevlar. A steering mechanism maintains a position of the ink band with respect to the carrier belt. The steering mechanism includes a rotatable shaft attached to one of the carrier rollers that is configured to adjust a position of the carrier roller in a direction perpendicular to a direction of travel of the carrier belt.

In some embodiments, a printing apparatus comprises an ink band capable of holding hot melt ink thereon, an ink feed device configured to deposit hot melt ink on the ink band, ink band rollers configured and arranged to hold and transport the ink band with respect to a substrate, a printhead configured to thermally transfer a portion of hot melt ink from the ink band to the substrate to print on the substrate, a carrier belt in contact with the ink band, the carrier belt being formed of at least a first material component and a second material component, the first material component providing the carrier belt with compliance that controls the thickness of the hot melt ink deposited on the ink band in conjunction with the rigid blade, and the second material component prevents or reduces elongation of the carrier belt carrier rollers configured and arranged to hold and transport the carrier belt with respect to the ink feed device, and a rigid blade configured and arranged to cause hot melt ink to pass between a blade edge of the rigid blade and the ink band, wherein the rigid blade is shaped to minimize a contact area between the rigid blade and the ink band while controlling ink thickness of the hot melt ink on the ink band.

In some implementations, the compliant layer provides a compliance amount that is matched to a pressure exerted by the rigid blade, which produces a desired ink coating thickness.

The systems described herein advantageously allow the deposition of a thin, uniform layer of ink onto the ink band. Thin ink layers and consistent ink layers improve print quality. The system advantageously reduces wear on the ink band, potentially increasing the life of the ink band while maintaining high speeds. Other advantages include that the system can work in any orientation and requires no extra process to remove ink from the band to create a fresh ink coating.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
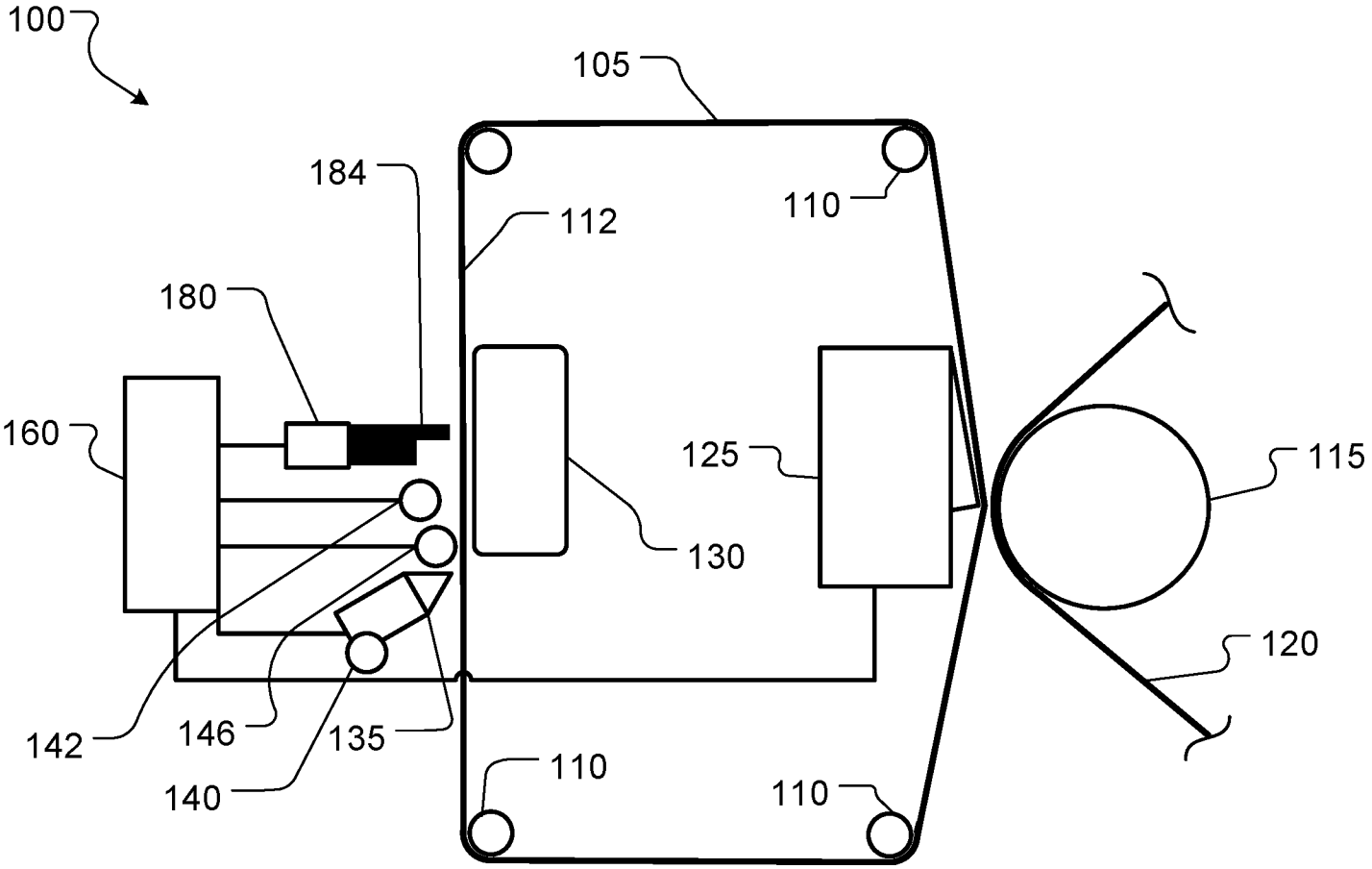
FIG. 1 shows an example of a thermal transfer printer with a rigid blade.

FIG. 1 shows an example of a thermal transfer printer 100. The thermal transfer printer 100 includes an ink band 105 that is held and transported using guides and/or rollers, which can include routing rollers 110, and a drive roller 112. The drive roller 112 holds the ink band 105 and is responsible for the motion that transports the ink band 105 through the thermal transfer printing apparatus 100. The drive roller 112 is advantageously located to pull the ink band 105 locally relative to a re-inking station (rather than pushing it locally through the re-inking station or pulling through a longer length of the band), however the drive roller 112 can be positioned at other locations, or more than one drive roller is possible. The band can be made of various materials, as described in detail below. Selection of an appropriate thickness for a given type of band material can result in good heat transfer characteristics through the ink band 105, allowing high quality prints at high speed, while also maintaining the durability of the ink band 105. A print roller 115 can be used to transport a substrate 120 (e.g., paper or plastic) proximate to the ink band 105. A thermal transfer printhead 125 is adjacent to the substrate 120 and is used to transfer hot melt ink from the ink band 105 to the substrate 120. In some implementations, the printer 100 can be reconfigured to position the substrate 120 adjacent the printhead 125 on a printing platen that can replace the roller 115.

In some implementations, an inking platen 130 contacts a back side (i.e., non-ink side) of the ink band 105 and holds the ink band 105 in position relative to a re-inking station while the ink band 105 can slide over the surface of the platen 130 that holds it in position relative to the re-inking station. Alternatively, a roller (e.g., a rotatable platform) can be used in place of the platen 130, and the contacting surface of the roller moves with the ink band 105. The features described below with respect to the platen 130 can be implemented with a roller instead, in various implementations.

In some implementations, the platen 130 has a fixed position. In other implementations, the platen 130 (or roller) is moveable, such as in response to a control signal during printing or for purposes of installing or replacing the ink band 105 in the printer 100. The platen 130 presents a firm surface to the back side of the ink band 105. For example, the platen 130 can be made of metal and be generally unyielding when pressure is applied. In other implementations, the platen 130 is compliant (e.g., includes a compliant exterior layer).

The thermal transfer printer 100 includes an ink feed device 135 to add additional hot melt ink to the ink band 105 (as needed) and a blade support 180, which holds a rigid (e.g., metal) blade 184 that is pressed against the ink band 105. There are various ways to implement the blade 184, including those described below as blades 200, 250, 260, and 370. Methods of inking the ink band 105 are described in WO 2018/065959, the contents of which is incorporated herein by reference. In various implementations, the rigid blade 184 is made of metal, such as aluminum, stainless steel, titanium, or a combination of these. In addition, in some implementations, the rigid metal blade 184 is coated with an additional material to prevent or reduce wear and abrasion. For example, in some implementations, the rigid metal blade 184 is coated with an amorphous fluoroplastic, such as one or more types of Teflon® PTFE (Polytetrafluoroethylene) coating materials, available from E. I. Du Pont de Nemours and Company (also known as DuPont) of Wilmington Del.

The blade 184 can be held orthogonal or at another angle to the direction of travel of the ink band 105. During printing operations, the blade 184 is pressed against the platen 130, trapping the ink band 105 against the platen 130.

In some implementations, the platen 130 is heated to ensure the hot melt ink on the ink band 105 is in a molten state as it approaches the blade 184. Additionally or alternatively, a heater 142 can be included to heat the ink so that it is fully melted before it reaches the blade 184. The heater 142 can be an infrared lamp or other radiant heater. An example of a radiative heat source is described in WO 2018/065959. In general, one or more heating devices are included. For example, in addition to using a heated platen 130, a heater 142, or both, the ink feed device 135 can be a heated ink feed device. In any case, at least one heating device should be close enough to the blade 184 to ensure that the hot melt ink is maintained in a molten state at the location of the blade 184. Moreover, the specific sequence of components leading up to the blade 184 can be changed, e.g., a heated ink feed device 135 can be placed before or after the heater 142 in the direction of travel of the ink band 105.

One or more controllers 160 are also provided, each or all of which can be included in the thermal transfer printer 100 or be separate from the printer 100 but still be included in a larger printing apparatus or system. In some implementations, controller(s) 160 operates the various components of the printer 100, including the printhead 125, the heated ink feed device 135, the heater 142, the blade support 180, and potentially a heated platen or roller 130. The controller(s) 160 can be implemented using special purpose logic circuitry or appropriately programmed processor electronics. For example, the controller(s) 160 can include a hardware processor and software to control the printer 100, including controlling the speed of the ink band 105 to match the speed of the substrate 120, and the delivery of data to the printhead 125. The data can be delivered digitally, and the data can be changed with each print while the ink band 105 and substrate 120 continue to move at the same speed (e.g., 400 mm/s).

The controller(s) 160 for the printer 100 can provide control signals to a blade support 180 to position the blade 184 relative to the speed of the ink band 105, (e.g., during set-up or after replacement of an ink band 105) or to prevent wear during periods of non-printing. The controller(s) 160 can include (or be coupled with) one or more sensors to assist in carrying out its functions. For example, a speed sensor can be associated with the ink band 105 to monitor the speed of the ink band 105. Alternatively, the speed of the band can be known by the controller(s) 160, without the use of a sensor, as when the controller(s) 160 controls the speed of the ink band 105. In addition, a thickness sensor can be associated with the ink band 105 to monitor a thickness of the hot melt ink on the ink band 105 after the blade 184. A temperature sensor 146 can be located near the ink band 105 to determine the temperature of the ink being melted onto the band. A temperature sensor 140 can also be part of the ink feed device 135 and register a temperature of the heated ink. The one or more sensors can include a deformation sensor to maintain the uniform coating height. In some implementations, the deformation sensor can be a spring-steel lever connected to a strain gage, such as P/N MMF307449 from Micro-Measurements (Raleigh, N.C.). Note that the controller(s) 160 can be divided into various subcomponents, which can operate in cooperation with each other or separately control the components of the printer 100, and further details regarding examples of control subsystems are described below in connection with FIG. 9.

Figure 2:
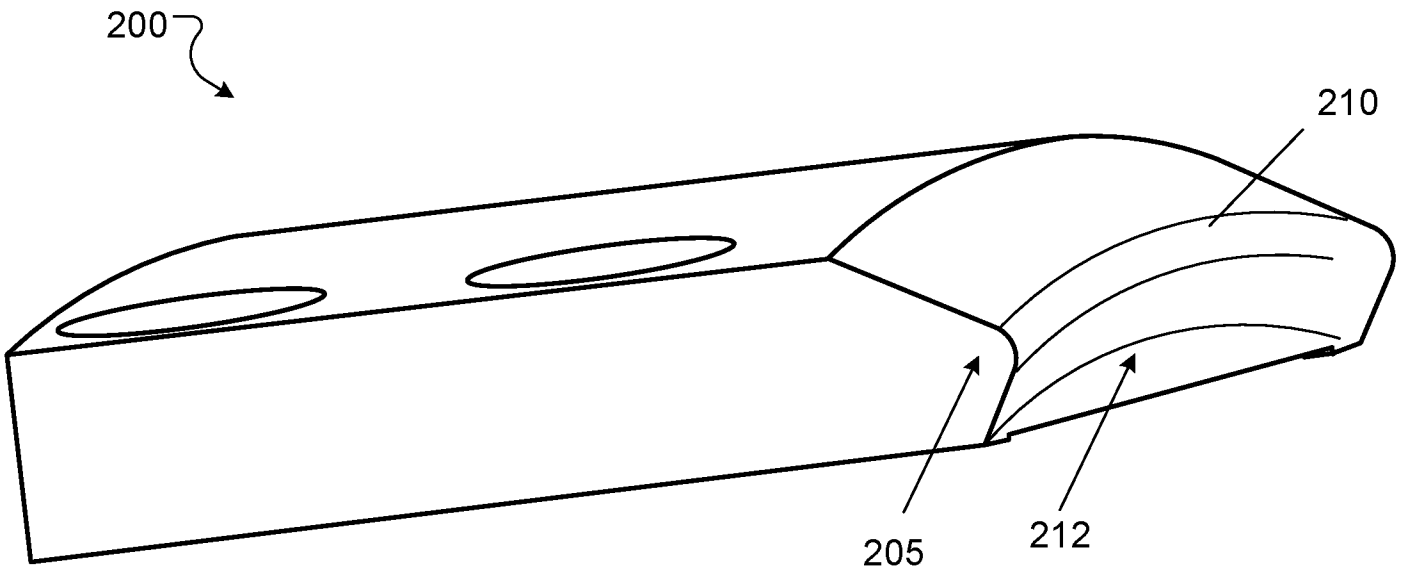
FIG. 2 shows an example of a rigid blade that can be used in the thermal transfer printers of FIGS. 1, 6, and 8.

FIG. 2 shows an embodiment of rigid blade 200 used in the thermal transfer printer of FIG. 1. The rigid blade 200 has a blade edge 210 with a specified radius of curvature 205 at the tip and angles leading thereto. As shown in FIG. 2, the blade edge 210 of the rigid blade 200 also has a lateral curvature 212. The lateral curvature 212 is shaped so as to push ink toward a center line of the rigid blade 200. This pushing of the ink can help prevent overflow of the ink beyond the lateral sides of the rigid blade 200. The lateral curvature can also prevent bulging in the ink band 105, which affects the ink deposition onto the ink band 105.

The width of the blade can be between 25 mm to 130 mm. The width of the blade 200 depends on the width of the ink band 105 and the printhead 125. In many implementations, the blade 200 will be wider than the printhead 125 of the thermal transfer printer, and the width of the ink band 105 will also be wider than the printhead and may be wider than the blade 200. In various implementations, the printhead is from 32 mm to 128 mm (e.g., 53 mm) wide.

Figure 3A:
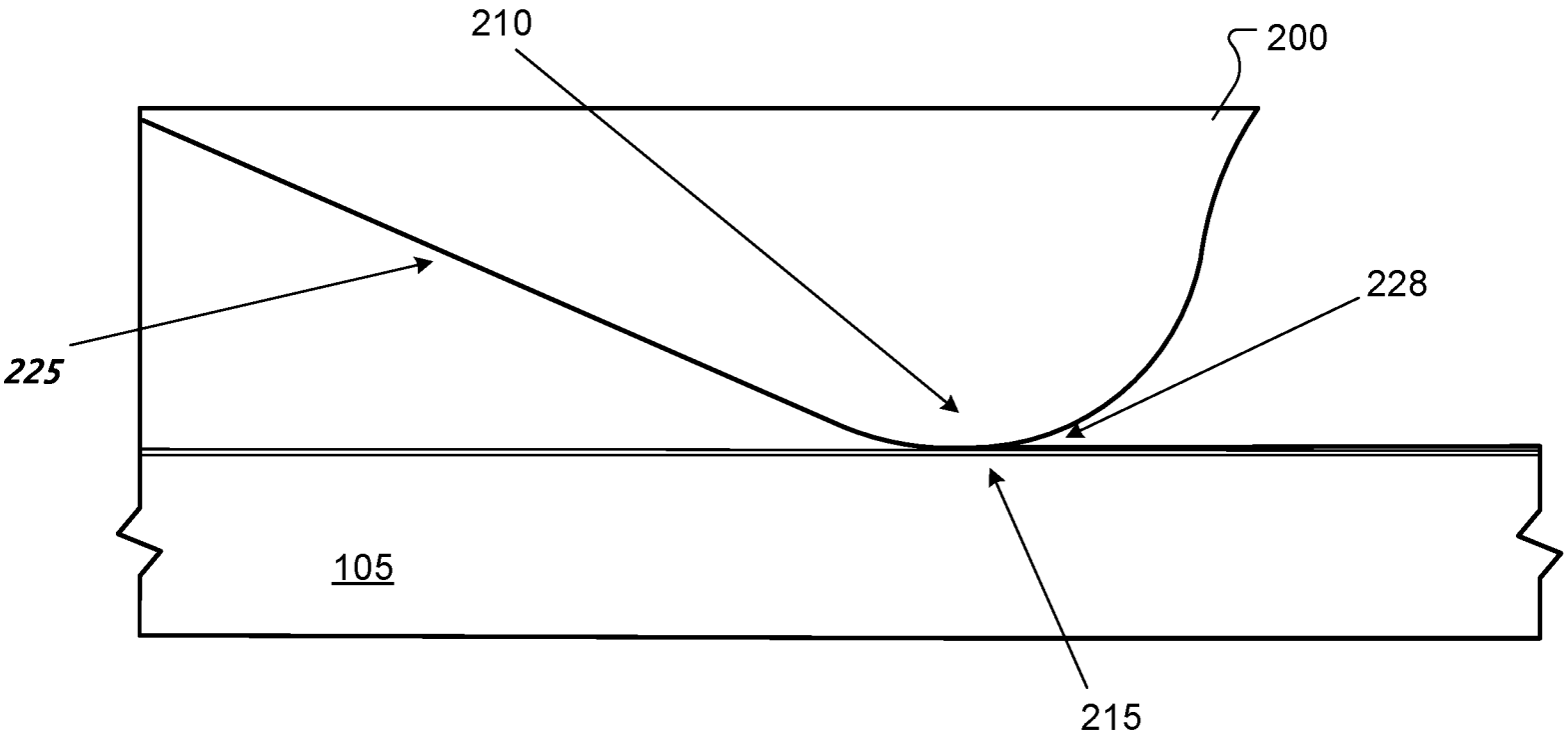
FIG. 3A-B show cross-sectional views of an example of a rigid blade used in the thermal transfer printers of FIGS. 1, 6, and 8.
Figure 3B:
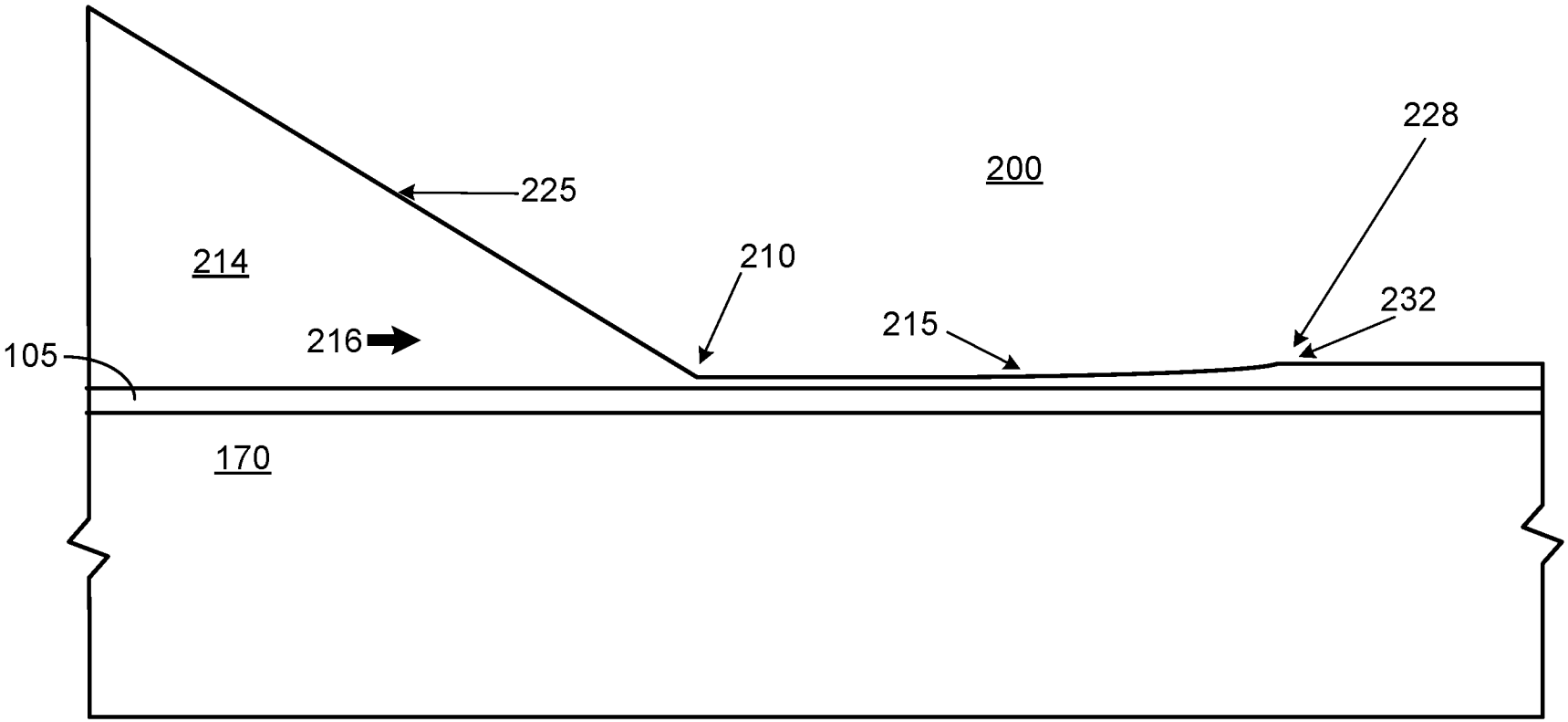

Referring to FIGS. 3A-B, the blade 200 is positioned with respect to the ink band 105, where the ink band 105 which can overlie a compliant material on a platen or roller, or overlie a compliant material carrier belt as part of the ink band 105 at the surface in contact with the blade edge 210. To reduce pressure on the ink band 105, the blade edge 210 advantageously presents a small surface to the ink band 105. For example, a tooling radius of 0.2 mm can be used to produce a small radius. In some embodiments, the radius of the blade edge 210 can be less than 0.5 mm, less than 0.4 mm, less than 0.3 mm, less than 0.2 mm, or less than 0.1 mm. As the radius is increased, the contact surface 215 or ink coating zone between the blade edge 210 and the ink band 105 increases, and the resulting ink height increases, potentially more than is desirable.

FIG. 3B shows ink 214 travelling in the direction 216 with respect to the ink band 105. The position of the blade 200 is represented, although the blade itself is not shown. The ink coating zone 215 is shown in greater detail; if minimized as much as possible the pressure on the ink band 105 (and a carrier band 170 discussed in detail below) will decrease and lead to lowered stress imposed on the ink band 105. The length is limited to approximately 0.3 mm (the minimum possible with current tooling limitations).

The lead-in slope 225 is the angle at which the blade edge 210 creates a funnel through which the ink 214 must pass. The lead-in slope 225 has an angle above 30 degrees and below 90 degrees, the angle being used in any given implementation based on the ink used. For example the angle can be 45 degrees.

Functionally, the ink 214 entering into the angle area of the blade along the lead-in slope 225 develops a vortex 244 (shown in FIGS. 3C and 3D) within the ink 214 caused by the relative movement of the band 105 to the blade 200. The slope of the angle determines how far under the blade 200 the vortex is wedged and how much upward pressure is exerted on the blade 200 and how much downward pressure is exerted on the band 105.

Figure 3C:
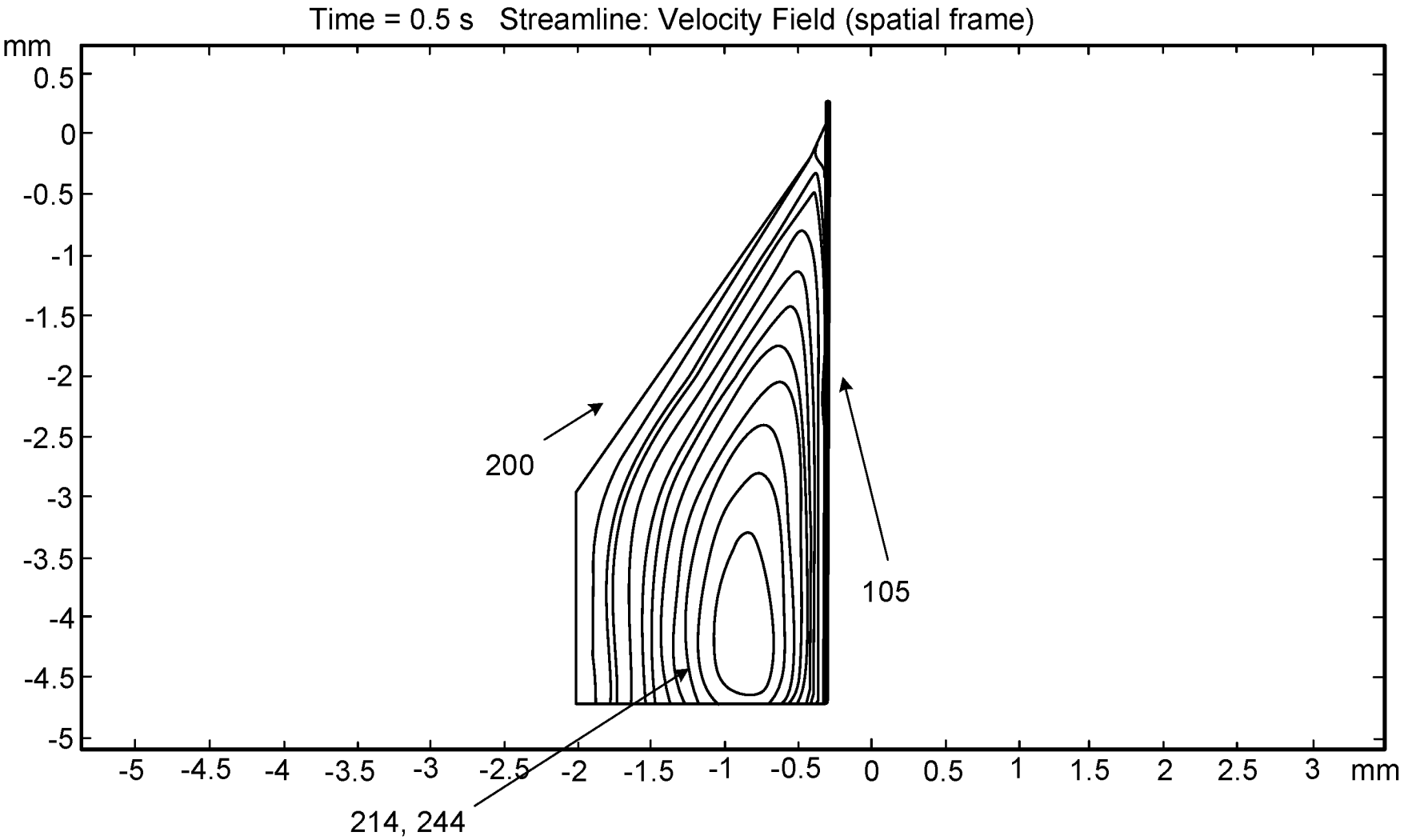
FIG. 3C-D show results of computer modelling visualization of the flow stream at the rigid blade.
Figure 3D:
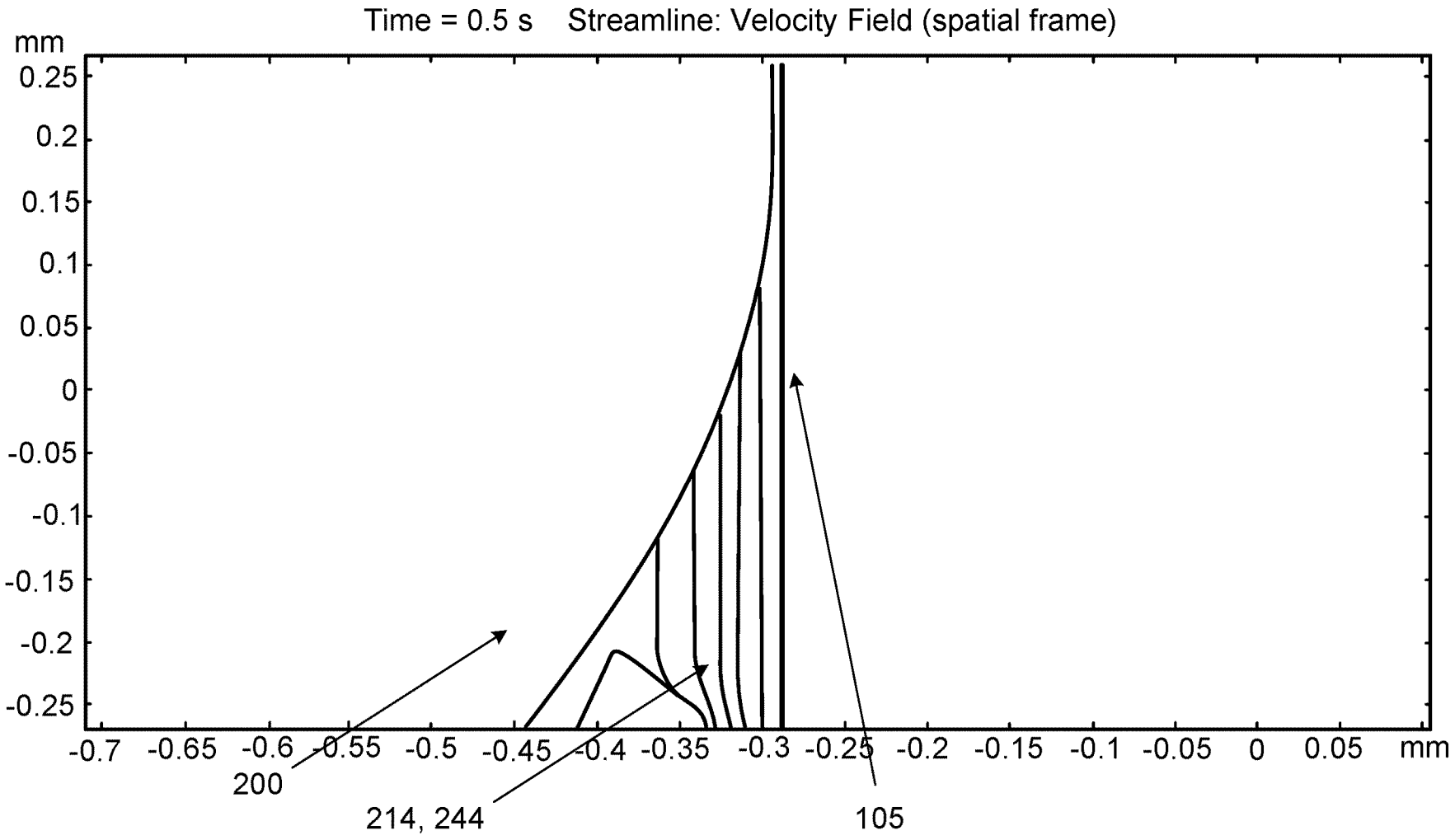

FIGS. 3C and 3D are graphs showing a result of a computational model of the velocity field that develops in the angled area of the blade lead-in, the ink vortex 244 at the point represented by the blade edge 210 of FIG. 3B. The graphs show the vortex 244 in a vertical orientation (e.g., rotated with respect to FIG. 3B) with the blade 200 on the left portion of the figure and the area to the right of the vortex 244 being the band 105 (and compliant carrier band 170). FIG. 3D is an enlargement of the top portion of FIG. 3C. The size of the vortex is viscosity dependent. The ink 214 used in some implementations is non-Newtonian (e.g., shear thinning) and thus the vortex 244 can have a thinning effect on the ink.

Modelling was carried out for visualization of the flow stream at the blade. In this computer testing, ink viscosity $\mu$ is a function of temperature T and shear rate $\gamma$, ink pressure P is a function of $\mu$, ink velocity v (which is equivalent to band speed v) and the contact area of the blade is A. The displacement of the rubber carrier belt u is a function of P and rubber shore hardness S. The ink height h is a function of u.

The desired ink thickness, h, can be 4 microns. To make h as small as possible, it is desirable to minimize the deflection of the carrier belt material. However, a solid surface with no compliance increases the pressure P and risks tearing the thin band. To allow a higher durometer carrier belt without risking tearing the ink band, P is reduced. This is carried out by an increase in T to above a critical level, e.g., 120° C. for the ink used in testing (with ink materials of ethylene vinyl acetate (EVA), wax, resin) with μ around 10 Pa·s. This can be achieved by increasing heat supplied to the coating mechanism. The band speed v can be reduced (undesirably) as can the blade area A (making the blade edge as small as possible). The area can be reduced by removing the edge radius so that the blade goes directly from a 45 degree entry angle to the blade length 215 (as shown in FIG. 3B). An upper maximum of 1200 mm/s coating speed has been demonstrated to date. Shore hardness S can be increased by choosing a harder rubber to above a level of 75 Shore A Hardness and it was ensured that the surface irregularities were as small as possible. Results of the modelling visualization of the flow stream at the blade is shown in FIG. 3C with a zoomed in view in FIG. 3D.

The rigid blade 200 can be curved in the Z dimension as seen in FIG. 2. As best seen in FIG. 2, the blade 200 is curved to keep ink from rolling off the band at the edges of the blade and can funnel the ink 214 in more than one dimension.

The blade exit slope 228 is the angle at which the blade edge 210 creates a funnel through which the ink exits. The blade exit slope was determined to have an angle of above 30 degrees and below 90 degrees. On the same edge, the beginning of the ink/air interface 232 is where the ink creates an interface surface with external air.

Figure 4:
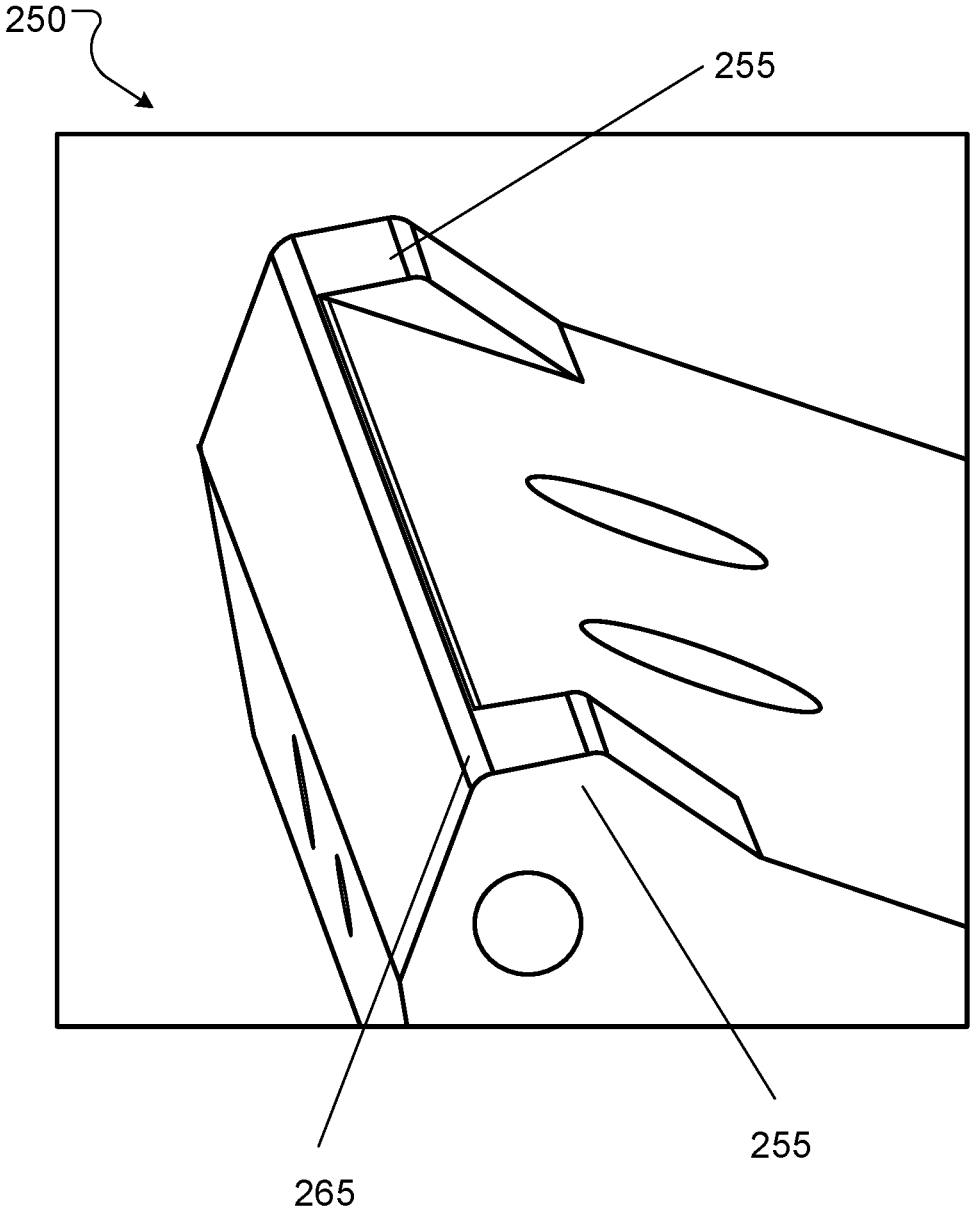
FIG. 4 shows an additional example of a rigid blade tip that can be used in the thermal transfer printers of FIGS. 1, 6, and 8.

FIG. 4 shows an additional example of a rigid blade 250. The rigid blade 250 has a blade edge 265 configured to cause the ink to funnel between the body of the rigid blade 250 and the ink band 105. The rigid blade 250 includes side shields 255 at either side of the blade 250. These side shields prevent ink overflow beyond the lateral edges of the blade 250.

Control of the ink includes control of the ink thickness. Generally, the position of the blade support 180 relative to the platen 130 controls the pressure exerted by the blade 200 or 250 and the ink thickness on the ink band 105, i.e., the height of the ink as it leaves the blade at the ink/air interface 232. The controller(s) 160 can provide control signals to the blade support 180 to reposition the blade 200, 250 in accordance with a viscosity of the hot melt ink and the speed of the ink band 105. However, the viscosity of the ink decreases as the ink is heated. Rather than repositioning the blade due to the viscosity of the hot melt ink, the desired ink height (e.g., exiting from the ink/air interface 232 in FIG. 3B) can be achieved by modulating the viscosity of the hot melt ink by adding more heat to the ink. High relative speeds between the blade 200, 250 and the ink band 105 can be achieved by adding more heat to the ink, thereby reducing the force exerted by the ink. Thus the blade 200, 250 is fixed in place and only the variation of heat energy from the heater 142 is used to regulate the ink height.

In addition, in some implementations, the controller(s) 160 provides control signals to adjust a position of the blade 200, 250 to compensate for wear of the blade material, which alters the mechanical properties of the blade 200 over the course of time. In some implementations, the controller (s) 160 also receives an input from a sensor monitoring the coating thickness. Thus, the controller(s) 160 can implement a closed loop control system controlling the ink thickness based on the sensor signal by varying the ink viscosity. These adjustment mechanisms are described in further detail below in connection with FIG. 9.

Figure 5A:
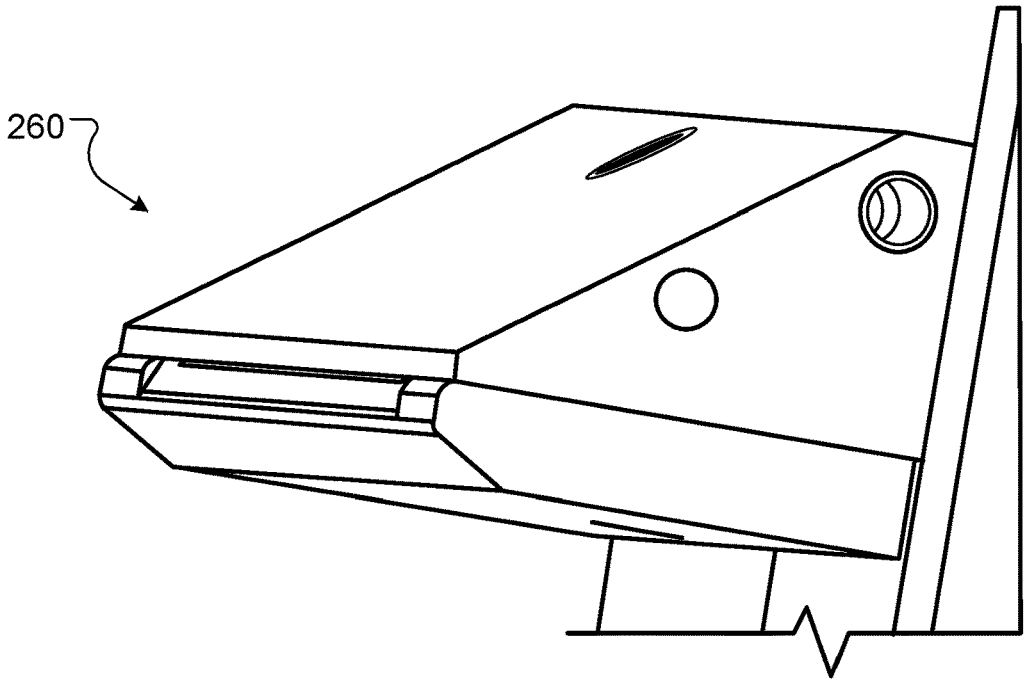
FIGS. 5A-B show an additional example of a rigid blade tip that can be used in the thermal transfer printer of FIGS. 1, 6, and 8.
Figure 5B:
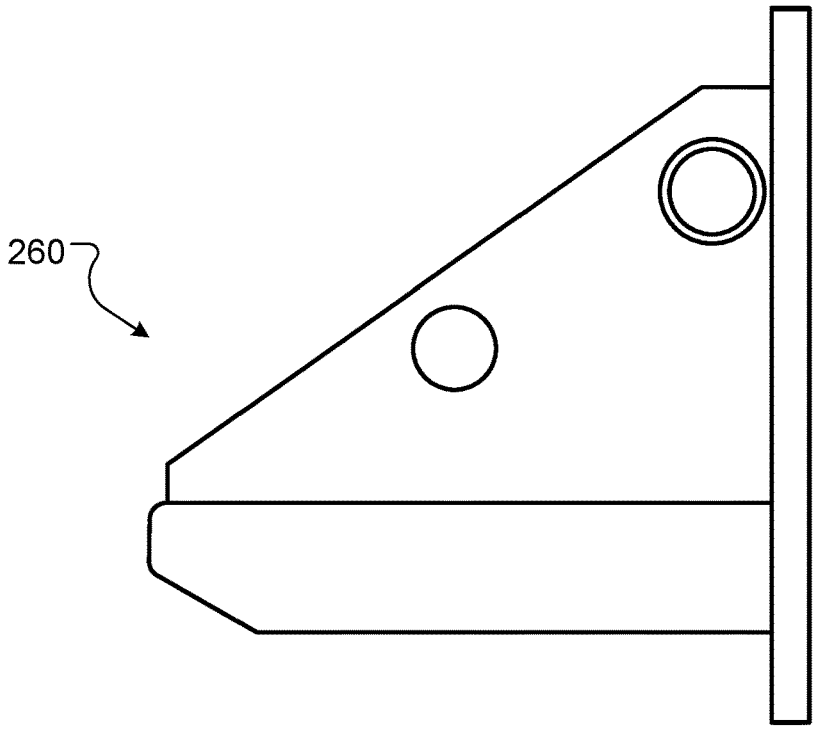

FIGS. 5A and 5B show an additional example of a rigid blade 260 that can be used with the system 100 and the systems described below. The blade is connected to an apparatus containing a narrow channel configured to deliver ink to the blade. The channel can be heated. The apparatus can also contain a reservoir of ink. The ink can be moved from the reservoir through the narrow channel to the blade by pressurizing the ink supply. Ink can be metered according to the usage of ink while printing.

Figure 6:
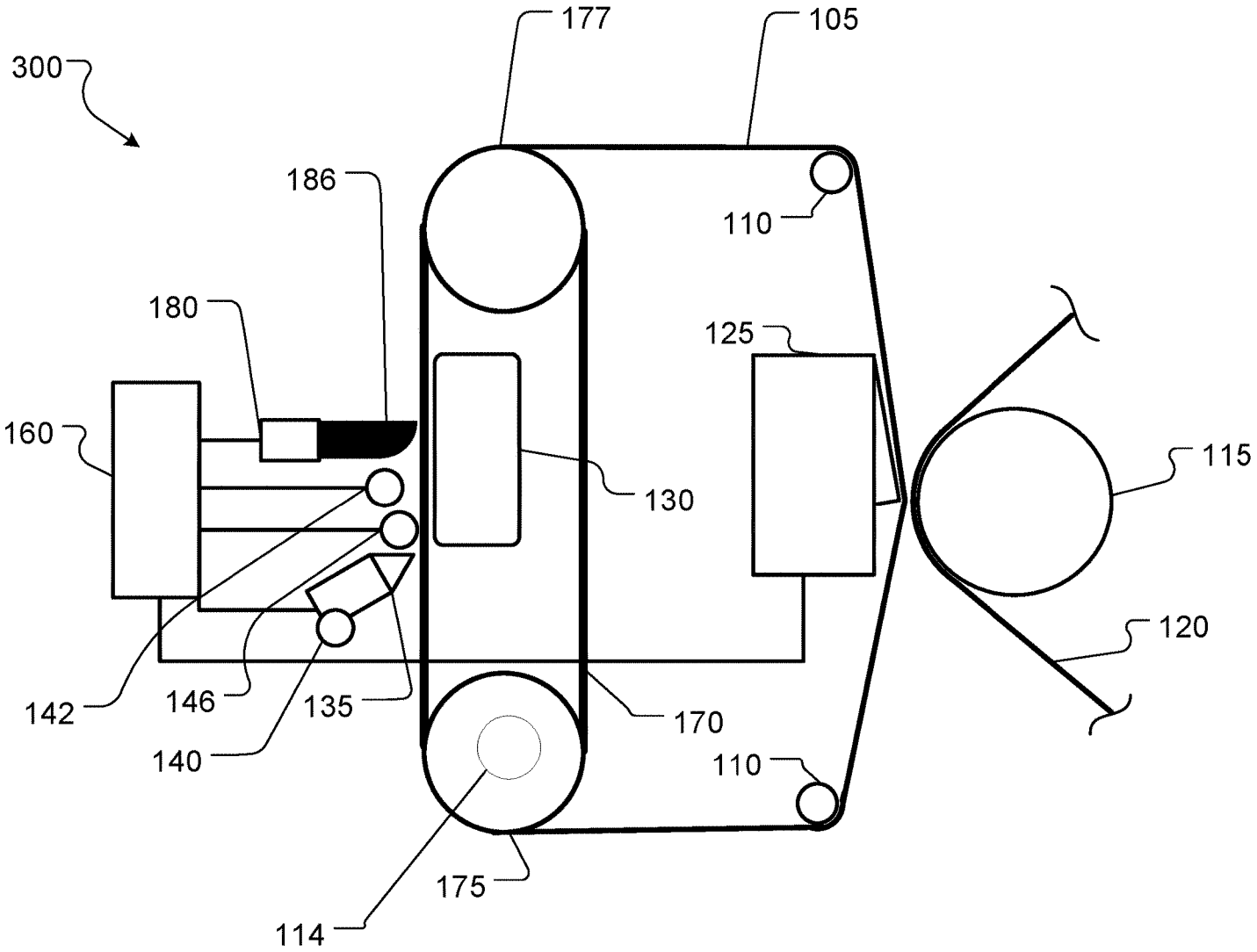
FIG. 6 shows an example of a thermal transfer printer with a compliant carrier.

FIG. 6 shows another example of a thermal transfer printer 300. The thermal transfer printer 300 has many of the same features as the thermal transfer printer 100 of FIG. 1. In addition to an ink band 105, the thermal transfer printer 300 includes a carrier belt 170. The carrier belt 170 is held and transported using carrier rollers 175, 177. The carrier roller 177 can be a driver roller that pulls the carrier belt 170, and thus the ink band 105 from bottom to top in this figure. The carrier belt 170 supports the ink band 105 and is at least partially responsible for the motion that transports the ink band 105 through the thermal transfer printing apparatus 300. As the carrier belt 170 and the ink band 105 are separate bands, a steering mechanism maintains the relative position between the two bands. The steering mechanism keeps the ink band 105 centered under the print head 125 and a rigid blade 186 and steers the ink band 105 relative to the carrier belt 170. The blade 186 can be a traditional rigid blade. The steering mechanism can include a rotating shaft 114. This rotating shaft 114 is a steering mechanism that causes tension on one edge of the band and slack on the other edge of the band, causing the band to track toward the tensioned side. A non-contact edge sensor (e.g., an infrared LED transmitter and photo diode receiver or an ultrasonic sensor) is used to sense if the band is off track. The rotating shaft 114 thus acts to keep the ink band 105 centered on the carrier belt 170. The rotating shaft arm 114 attaches to the carrier roller 175, and causes the carrier roller 175 to move slightly to either side along a direction perpendicular to the direction of travel of the band 105 (e.g., into and out of the plane of the page of the figure). In some implementations, the rotating shaft 114 works in conjunction with a band position sensor that detects a position of the ink band 105 relative to the carrier belt 170. The rotating shaft 114 adjusts the centerline of the carrier belt 170 along the axis perpendicular to the direction of travel to compensate for any drift of the bands relative to each other. This action keeps the centerline of the ink band 105 aligned with the centerline of the carrier belt 170. Additionally, a flange on one or both of the carrier rollers 175, 177 can hold the carrier belt 170 in place, e.g., along the centerline of the rollers. Roller 110 can be configured to be a dancer arm to take up slack in the ink band 105.

Figure 7:
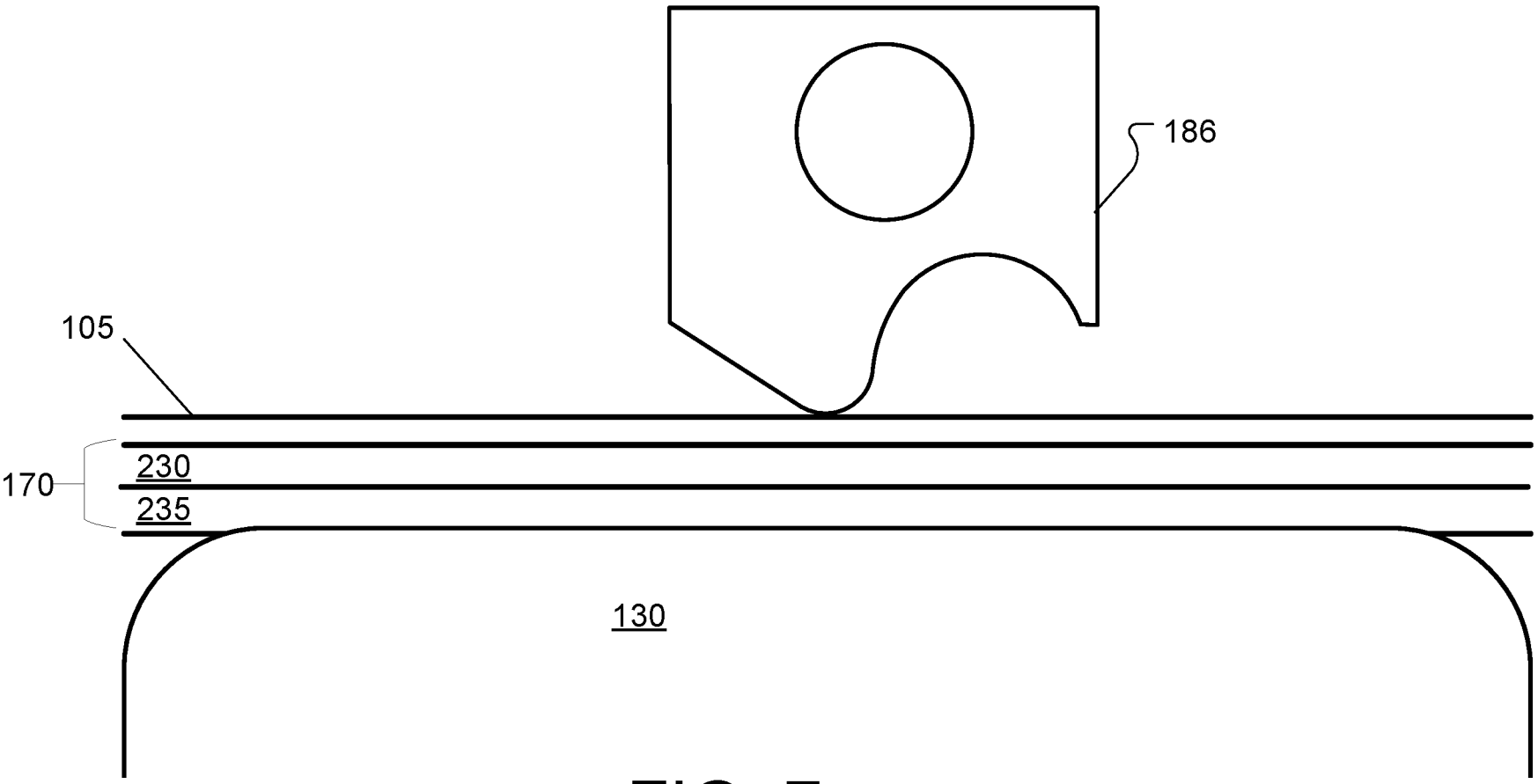
FIG. 7 shows an example of a thermal transfer printer with a rigid blade and a compliant carrier.

Referring to FIG. 7, the carrier belt 170 is designed as a seamless carrier loop that transports the ink band 105 around the printer 300. The carrier belt 170 is made from two layers, a top compliant layer 230 and a bottom substrate layer 235. The top compliant layer 230 acts to control the thickness of the ink layer when pressed against the rigid blade 186, while the bottom substrate layer 235 acts as a carrier belt for transporting the compliant layer 230 and to prevent or reduce elongation of the carrier belt.

The bottom substrate layer 235 of the carrier belt 170 is in contact with the rollers 175 that move and guide the carrier belt 170 around the printer 600 and can be in contact with the platen 130. The bottom layer 235 is made of a firm material. For example, the bottom layer is made of Kevlar. The bottom layer 235 is a material with a high friction coefficient; such a high friction coefficient ensures that the carrier belt 170 remains in contact with the rollers 175, 177 and platen 130 without slipping. For example, the friction coefficient between the surface of the bottom substrate layer 235 and the rollers 175, 177 or platen 130 can be between 0.1 and 1. In some instances, the rollers 175, 177 and platen 130 can be coated with a silicone rubber, although any suitable material that can achieve a friction coefficient with Kevlar in the above range can be used. The platen 130 can be heated to provide consistent heat to the carrier belt to improve the coating process.

The bottom substrate layer 235 provides a firm backing for the ink band 105, enabling the ink band 105 to be transported around the printer 300 and also provides a firm support to the top compliant layer 230 of the carrier belt 170. The firmness of the bottom substrate layer 235 enables the blade 186 to exert pressure on the top compliant layer 230 without affecting the speed of travel of the ink band 105. For example, the bottom substrate layer 235 is made of a material with a Shore A Hardness of at least 60. For example, with a Shore Hardness A in the range of 60 to 90, or 70 to 80, 70 to 90, or 80 to 100 (all inclusive).

The top compliant layer 230 is made of a more compliant material than the bottom substrate layer 235. The compliant material of the top layer 230 provides a deformable material that enables the ink band 105 in contact with the top layer 230 to be coated with ink using the rigid blade 186. However, if the material is too soft, then the deformation of the rubber is too large and the coating process produces an ink layer that is too thick. For example, the top compliant layer 230 is made of a material with a Shore A Hardness of minimum 50 and maximum of 100. For example, with a Shore Hardness A in the range of 60 to 90, or 70 to 80, or 70 to 90. The top compliant layer 230 can be uniformly smooth to facilitate an even coating, e.g., have a surface roughness smaller than 5 μm, such as less than 4 μm, less than 3 μm, less than 2 μm.

In some instances, the material of the top compliant layer 230 can be rubber. In some implementations, hyperelastic polymers are used. Examples of materials that can be used include silicone, VITON® or EPDM or KALREZ. VITON® is a brand of synthetic rubber and fluoropolymer elastomer commonly used in O-rings. EPDM rubber (ethylene propylene diene monomer (M-class) rubber) is a type of synthetic rubber, which is an elastomer characterized by a wide range of applications. KALREZ® by DuPont is a perfluoroelastomer. The elastomer can be combined with chemicals or fillers to improve heat conduction, reduce friction, reduce compression set and control hardness, etc. In other implementations, other materials can be used for the compliant layer. In general, the compliant layer should be matched to the desired ink coating thickness and chemical compatibility.

If the material of the top compliant layer 230 is too solid (e.g., a linear elastic material), the pressure from the rigid blade 186 risks destroying the ink band 105 supported by the carrier belt 170, e.g., deforming or tearing the ink band 105. Proper rubber characteristics permit a controlled gap between the rigid blade 186 and the ink band 105 and allow only a small amount of ink to pass there between. In this manner, the rigid blade 186 and compliant carrier ink band 105 can create an ink coating that is less than 4 μm thick.

Furthermore, the two layers of the carrier belt 170 do not expand significantly under thermal stress. Such a thermal property ensures that the gap between the coating rigid blade 186 and the inked ink band 105 will be constant for a fixed speed. For example, the materials of both the top compliant layer 230 and the bottom substrate layer 235 tend to have a coefficient of thermal expansion in the range of $1e^{-6}$ to $3e^{-4}$ [1/K]. The materials also have an operating temperature up to 600 [K].

In some instances, the bottom substrate layer 235 is woven Kevlar and the top layer is 230 silicone rubber that is cast directly onto the bottom substrate layer 235. In such an arrangement no adhesive is used. In other instances, the top compliant layer 230 is adhered to the bottom substrate layer 235. The hyper elasticity of the rubber ensures that there is no permanent deformation as long as the rubber is not stretched beyond the deformation limit.

The ink band 105 can be operated at variable speeds while also being coated with ink to the correct thickness. By taking advantage of the shear-thinning properties of the ink, whereby the viscosity of the ink drops as the temperature increases, the thermal transfer printer 100 can produce a thin coating thickness (e.g., 4-10 μm) at a low cost.

Figure 8:
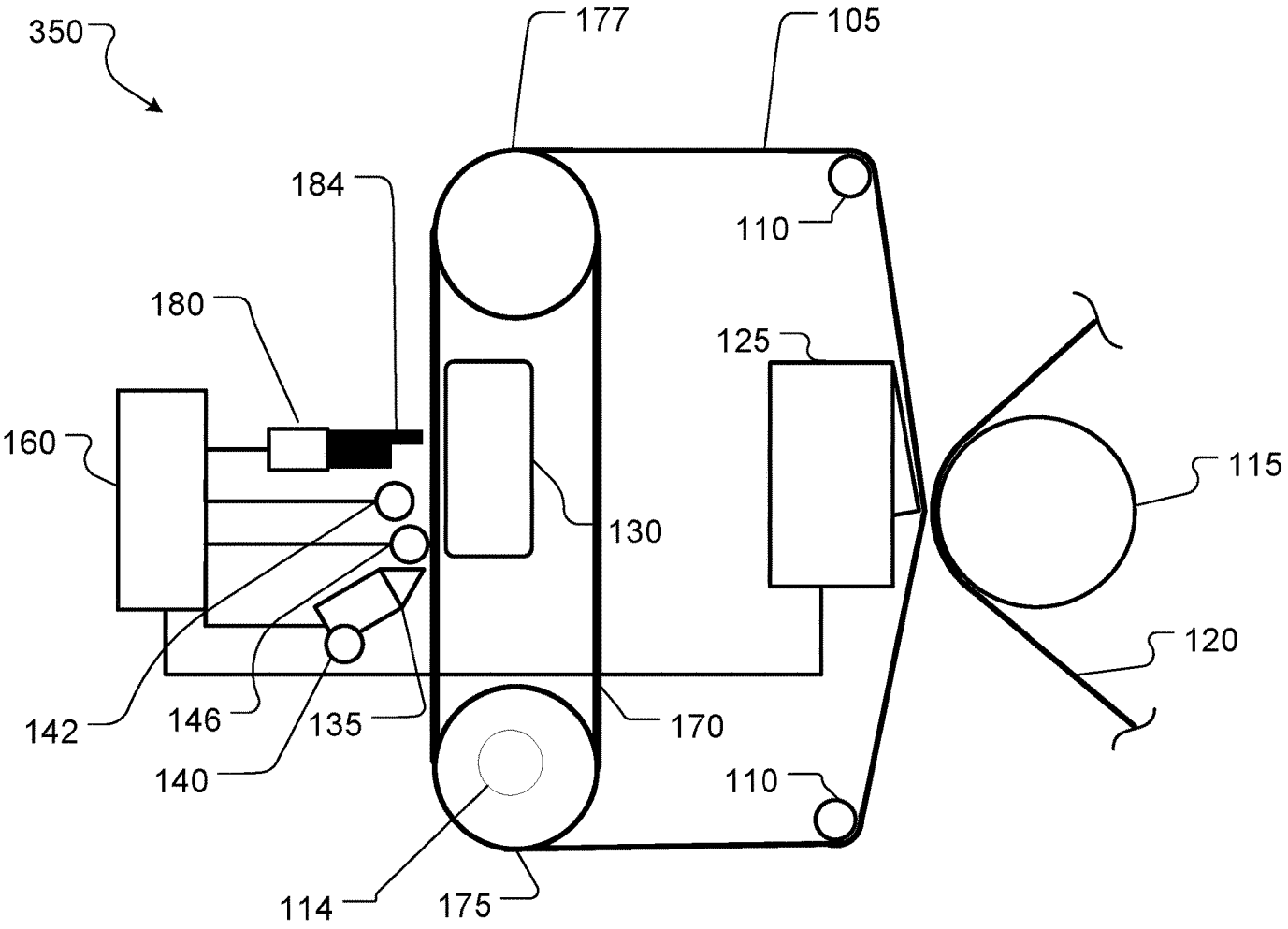
FIG. 8 shows an example of a thermal transfer printer with a rigid blade and details of a compliant carrier.

FIG. 8 shows another example of a thermal transfer printer 350. The thermal transfer printer 350 has many of the same features as the thermal transfer printer 100 of FIG. 1 as well as the features of the thermal transfer printer 300 of FIG. 6. The thermal transfer printer 350 includes a carrier belt 170 that supports the ink band 105 and is at least partially responsible for the motion that transports the ink band 105 to be inked, using the rigid blades described herein. The rigid blade 184 can be any of the rigid blades described, including rigid blades 200, 250, or 260 described above, or blade 370 described below.

Figure 9:
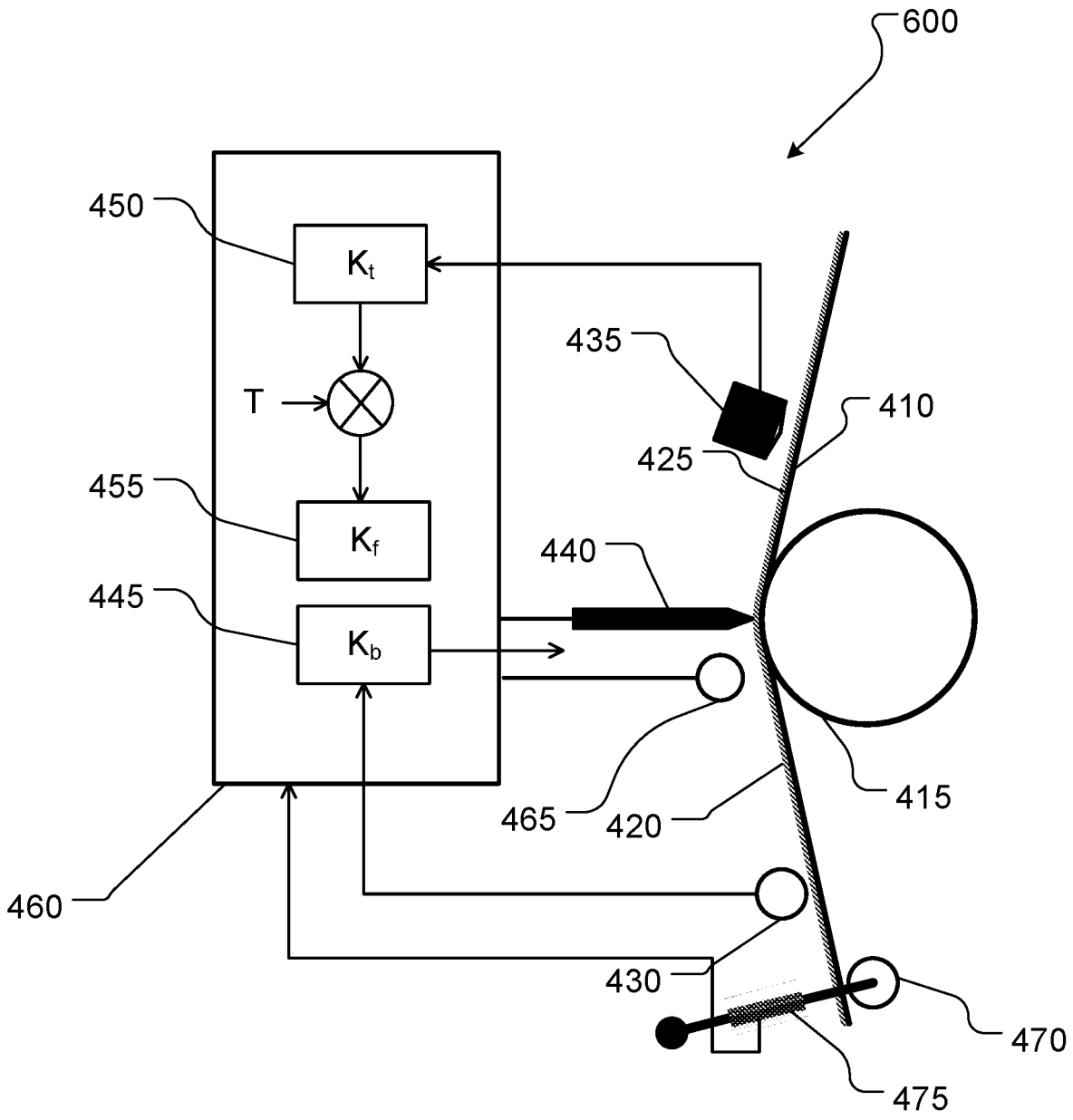
FIG. 9 shows an example of an ink monitoring control subsystem, which can be used in the thermal transfer printers of the present application.

FIG. 9 shows a portion 600 of a thermal transfer printer, including an example of an ink monitoring control subsystem 460, which can be used with the thermal transfer printers of the present application. For example, the portion 600 can be used with implementations that employ the carrier belt 170 and use blade 186, such as shown in FIG. 6.

The thermal transfer printer includes a band 410, a roller 415, and returning hot melt ink 420 on the band 410. In addition, a blade 440 conditions the ink on the band 410 and can be repositioned by translation, rotation, or both. The roller 415 can be a platen. A heater system 465 can add heat to the ink on the band 410 or the ink being applied to the band 410.

A speed sensor 430 can be used to monitor the actual speed of the band 410. The speed sensor 430 can be a roller attached to a rotary encoder, or any other appropriate device to measure speed. Moreover, in some implementations, the control system controls the speed of the band 410 and thus already knows the speed of the band without using a speed sensor. Nonetheless, it can be beneficial to include a speed sensor 430 to confirm the speed information. In any case, the speed can be monitored by the control system, which can apply a transfer function (Kb) 445 to the speed signal to determine the angle of the blade. In some implementations, the transfer function Kb is a linear function, e.g., the change in angle is directly proportional to the change in speed. In other implementations, the transfer function Kb is a non-linear function. The exact form of the function can be determined by the temperature and resulting viscosity of the ink on the band 410. In some implementations, the transfer function uses the shear and temperature dependent viscosity to extract the optimal blade angle based on the pressure generated by the coating speed.

For various implementations, to determine precise values to use for ink viscosity and coating speed, various computational modelling programs can be used, such as Computational Fluid Dynamics (CFD) software and/or Finite Element Analysis (FEA) software. For example, for a given ink, CFD software and FEA software can be used to generate a rheological characterization of the ink that shows the shear thinning of the ink and simulation results of the pressure change the ink undergoes when being applied to the band. Various methods can be used to measure the material's response to changing temperature, time and stress/strain, such as (1) a strain sweep method (the ink's response to increasing oscillating shear stress is measured at various predefined temperatures while holding frequency constant), (2) a thermal sweep method (the frequency and strain are held constant while the temperature is ramped between two values, e.g., from 70° C. to 140° C. at a rate of 5° C./minute), (3) a frequency sweep method (the time dependence of the ink's flow properties are measured while the strain and the temperature are held constant), and/or (4) a flow method (the dependence of viscosity on shear rate is measured at various predefined temperatures over a shear rate range, e.g., a shear rate range of 0.1 $sec^{-1}$ to 1000 $sec^{-1}$). Using such methods and known computer simulation programs, the ink(s) to be used can be analyzed to determine rheological characterizations corresponding to ink properties, such as ink viscosity shear and temperature dependence, which then informs the design of the thermal transfer printer system, as described herein.

In addition, an ink thickness sensor 435 observes the levelled ink 425 on the band 410 and provides a data signal to indicate whether the desired thickness is being achieved. The ink thickness sensor 435 can be a laser or ultrasonic sensing device, or any other appropriate device that can achieve the necessary resolution, e.g., a resolution that is at least ten times higher than the desired ink thickness. The desired ink thickness (T) can be received as an input, or be predefined for a given thermal transfer printer, and is used to control the heat added to the heater 440. The ink monitoring control subsystem 460 implements a closed loop control algorithm using the thickness value feedback from the ink thickness sensor 435, fed through a filter 450 implementing a transfer function ($K_t$) and a filter 455 implementing a forward transfer function ($K_f$). The exact value of the transfer functions $K_t$ and $K_f$ is determine by the mechanical layout of the final printer system and can be adjusted using standard control techniques, which are well understood in the field. The control algorithm can be implemented using electronic circuits or more typically a software algorithm within a control system microcontroller.

Figure 10:
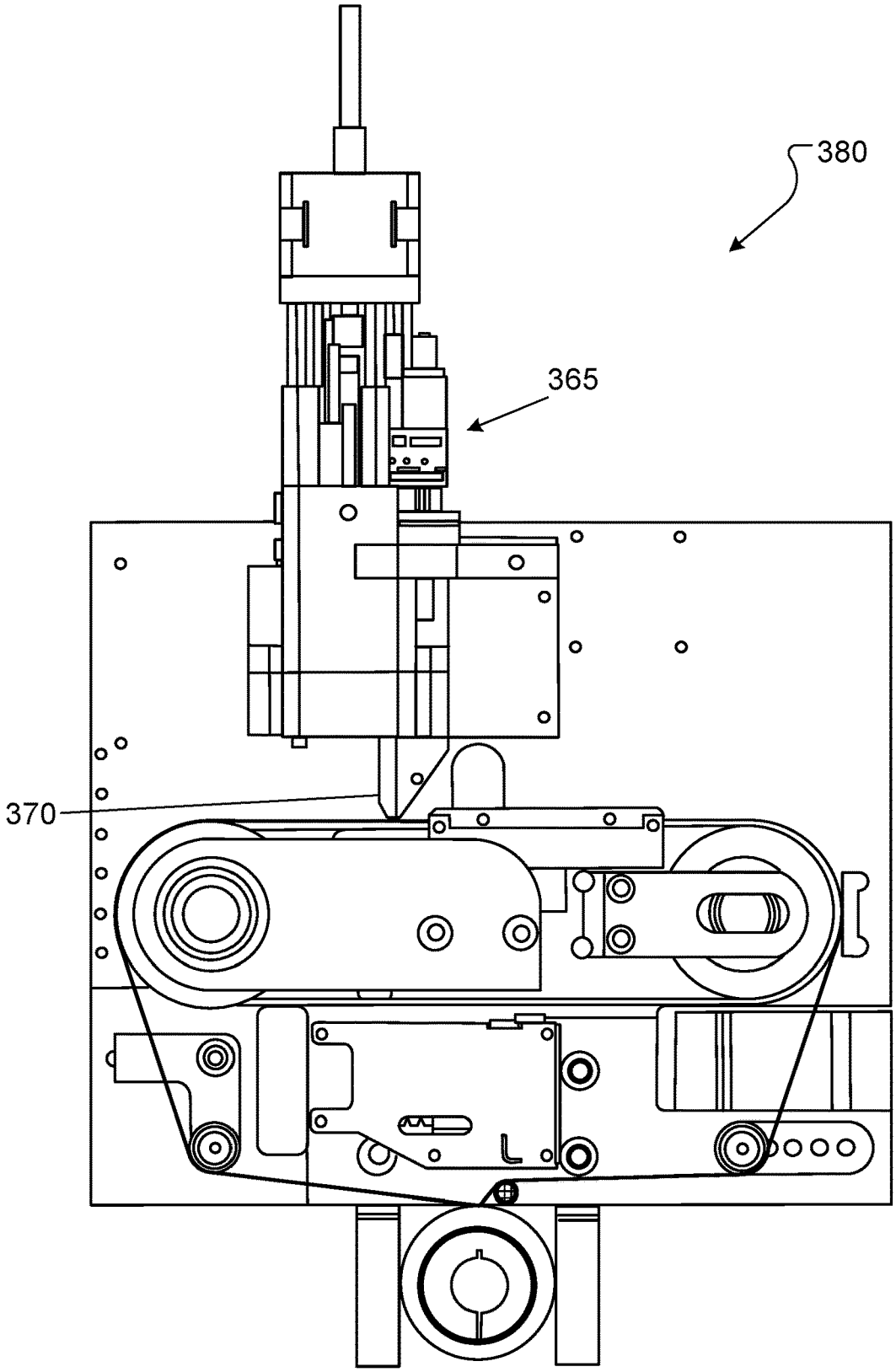
FIG. 10 shows a front view of a portion of the thermal transfer printer of FIG. 8 including a slot die ink delivery.
Figure 11A:
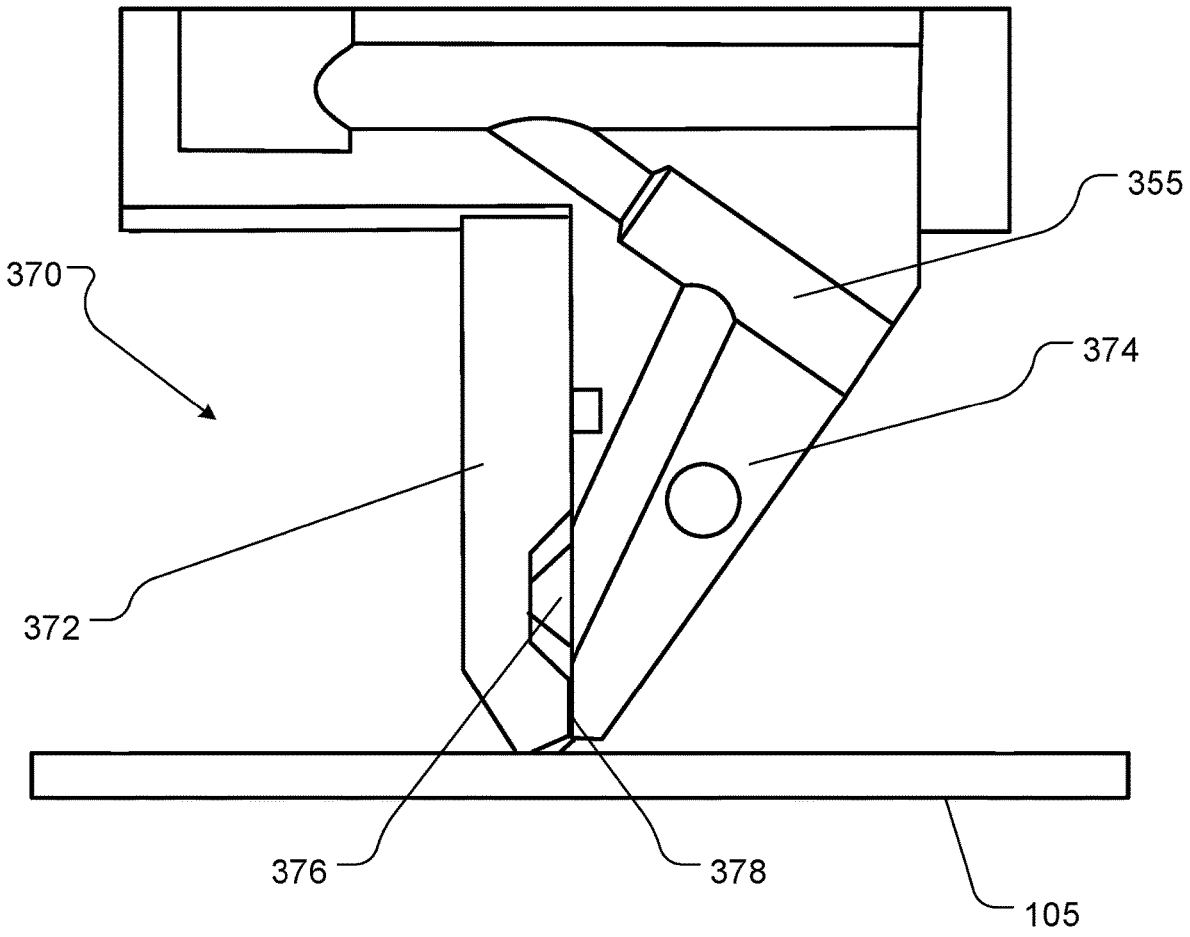
FIGS. 11A and 11B show an example of a rigid blade used with the slot die of FIG. 10 and includes an ink feed pocket and slot.
Figure 11B:
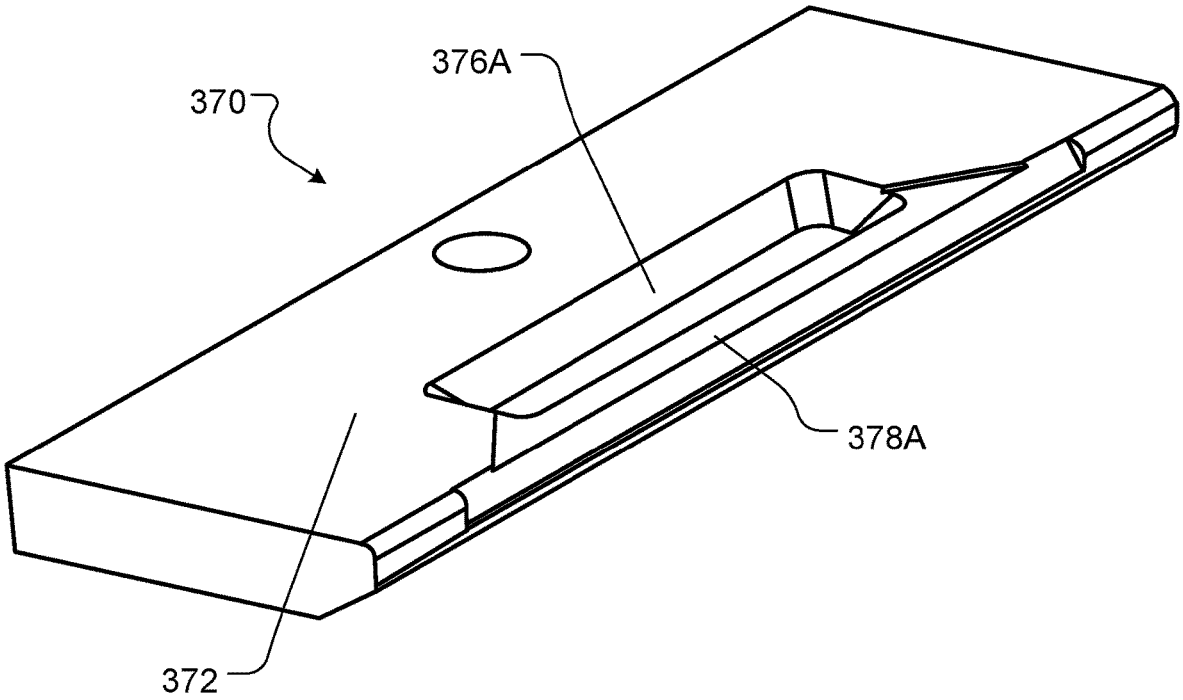

In some implementations, rather than using an ink feed device that is separate from a rigid blade, the ink feed device 135 and the rigid blade (and potentially the heater as well) can be combined into a single component, such as a slot die. FIGS. 10, 11A, and 11B show an example of a system 380 that uses a slot die system 365 with a blade 370. In such instances, the ink delivery includes a heatable slot die where ink is transferred between an ink reservoir and the slot die via a pump (such as a piston pump). The ink is delivered to a channel 355 in the rigid blade 370 (shown in FIGS. 11A and 11B) that terminates in an opening of a slot 378 positioned near to the ink band 105. The blade 370 has an edge portion 372 and a body portion 374 that when joined together forms a rigid blade that includes a pocket 376 fluidically connected to the channel 355 and to the slot 378 through which ink is delivered to the band 105.

FIG. 11B shows a view of the edge portion 372 of the blade 370 removed from the body portion 374. The surface 376A of the pocket 376 belonging to the edge portion 372 and the surface 378A of the slot 378 belonging to the edge portion 372 are both visible.

Embodiments of the subject matter and the functional operations described in this specification can be implemented using digital electronic circuitry, computer software, firmware, or hardware, including the structures disclosed in this specification and their structural equivalents, or in combinations of one or more of them. Embodiments of the subject matter described in this specification can be implemented using one or more modules of computer program instructions encoded on a computer-readable medium (e.g., a machine-readable storage device, a machine-readable storage substrate, a memory device, or a combination of one or more of them) for execution by, or to control the operation of, data processing apparatus. The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

While this specification contains many implementation details, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular embodiments of the invention have been described. Other embodiments are within the scope of the following claims. For example, pressure applied to the band can be used in addition to elevated temperature to sinter the band, such a pressure chamber or physical force on the band with particles. Moreover, the actions recited in the claims can be performed in a different order and still achieve desirable results. Accordingly, other embodiments are within the scope of the following claims.

What is claimed is:

1. A printing apparatus comprising:

a band capable of holding hot melt ink thereon;

rollers configured and arranged to hold and transport the band with respect to a substrate;

a printhead configured to thermally transfer a portion of hot melt ink from the band to the substrate to print on the substrate;

an ink feed device configured to add hot melt ink to the band and to heat the hot melt ink on the band; and a rigid blade configured and arranged to cause hot melt ink to pass between a blade edge of the rigid blade and the band, wherein the rigid blade is shaped to minimize a contact area between the rigid blade and the band while controlling ink thickness of the hot melt ink on the band.

2. The printing apparatus of claim 1, wherein the rigid blade has a blade edge with a radius of curvature between 0.15 and 0.3 mm.

3. The printing apparatus of claim 1, wherein the rigid blade has a front surface that forms an angle between 30 degrees and 90 degrees with respect to the band.

4. The printing apparatus of claim 1, wherein the rigid blade is configured to restrict ink from passing beyond lateral edges of the rigid blade.

5. The printing apparatus of claim 4, wherein the rigid blade has a lateral curvature that funnels ink towards a midline of the band.

6. The printing apparatus of claim 4, wherein the rigid blade has side shields at the lateral edges of the rigid blade.

7. The printing apparatus of claim 1, wherein the rigid blade has a rear surface that defines an ink/air interface and has an angle of above 30 degrees and below 90 degrees with respect to the band.

8. The printing apparatus of claim 1, wherein the ink feed device comprises a slot die in communication with a slot within a body of the rigid blade that delivers hot melt ink to the band.

9. A printing apparatus comprising:

an ink band capable of holding hot melt ink thereon;

an ink feed device configured to deposit hot melt ink on the ink band;

ink band rollers configured and arranged to hold and transport the ink band with respect to a substrate;

a printhead configured to thermally transfer a portion of hot melt ink from the ink band to the substrate to print on the substrate;

a rigid blade configured to control a thickness of the hot melt ink deposited on the ink band;

a carrier belt in contact with the ink band; and carrier rollers configured and arranged to hold and transport the carrier belt with respect to the ink feed device, wherein the carrier belt is formed of at least a first material component and a second material component, the first material component providing the carrier belt with compliance that controls the thickness of the hot melt ink deposited on the ink band in conjunction with the rigid blade, and the second material component prevents or reduces elongation of the carrier belt.

10. The printing apparatus of claim 9, wherein the carrier belt is formed from a single material that comprises both the first material component and the second material component.

11. The printing apparatus of claim 9, wherein the first and second material components are respective first and second layers.

12. The printing apparatus of claim 11, wherein the first layer comprises a material with a Shore A Hardness between 50 and 100.

13. The printing apparatus of claim 11, wherein the first layer is silicone rubber.

14. The printing apparatus of claim 11, wherein the first material component layer comprises a material with a Shore A Hardness between 60 and 100.

15. The printing apparatus of claim 11, wherein the second material component comprises a material that has a friction coefficient of greater than 0.1 when in contact with the carrier rollers.

16. The printing apparatus of claim 11, wherein the second layer is Kevlar.

17. The printing apparatus of claim 11, further comprising a steering mechanism that maintains a position of the ink band with respect to the carrier belt.

18. The printing apparatus of claim 17, wherein the steering mechanism includes a rotatable shaft attached to one of the carrier rollers that is configured to adjust a position of the carrier roller in a direction perpendicular to a direction of travel of the carrier belt.

19. The printing apparatus of claim 17, wherein the compliant layer provides a compliance amount that is matched to a pressure exerted by the rigid blade, which produces a desired ink coating thickness.

20. A printing apparatus comprising:

an ink band capable of holding hot melt ink thereon;

an ink feed device configured to deposit hot melt ink on the ink band;

ink band rollers configured and arranged to hold and transport the ink band with respect to a substrate;

a printhead configured to thermally transfer a portion of hot melt ink from the ink band to the substrate to print on the substrate;

a carrier belt in contact with the ink band, the carrier belt being formed of at least a first material component and a second material component, the first material component providing the carrier belt with compliance that controls the thickness of the hot melt ink deposited on the ink band in conjunction with the rigid blade, and the second material component prevents or reduces elongation of the carrier belt carrier rollers configured and arranged to hold and transport the carrier belt with respect to the ink feed device; and a rigid blade configured and arranged to cause hot melt ink to pass between a blade edge of the rigid blade and the ink band, wherein the rigid blade is shaped to minimize a contact area between the rigid blade and the ink band while controlling ink thickness of the hot melt ink on the ink band.

* * * * *